US005720855A

United States Patent [19]

Baird

[11] Patent Number: 5,720,855

[45] Date of Patent: Feb. 24, 1998

[54] COKE OVEN DOOR

[75] Inventor: Billy Carr Baird, Sturgis, Ky.

[73] Assignee: Saturn Machine & Welding Co. Inc., Sturgis, Ky.

[21] Appl. No.: 647,573

[22] Filed: May 14, 1996

[51] Int. Cl.[6] ..... C10B 1/06

[52] U.S. Cl. ..... 202/248; 110/173 R

[58] Field of Search ..... 202/248, 242; 110/173 R

[56] References Cited

U.S. PATENT DOCUMENTS

| | | | |
|---|---|---|---|
| Re. 34,184 | 2/1993 | Baird et al. | 202/248 |
| 1,908,467 | 5/1933 | Wolff | 202/248 |
| 2,126,239 | 8/1938 | Beimann | 202/248 |
| 3,172,825 | 3/1965 | Maloney | 202/248 |
| 3,486,986 | 12/1969 | Freund | 202/248 |
| 3,505,174 | 4/1970 | Peterson et al. | 202/248 |
| 3,567,590 | 3/1971 | Reinfeld et al. | 202/248 |
| 3,629,094 | 12/1971 | Silverblatt | 202/248 |
| 3,876,506 | 4/1975 | Dix et al. | 202/248 |
| 3,933,598 | 1/1976 | Pries | 202/248 |
| 3,950,228 | 4/1976 | Drebes | 202/270 |
| 3,974,038 | 8/1976 | Tucker | 202/248 |
| 4,032,409 | 6/1977 | Knappstein et al. | 202/248 |
| 4,080,266 | 3/1978 | Dix | 202/248 |
| 4,086,231 | 4/1978 | Ikio | 202/248 |
| 4,115,203 | 9/1978 | Naevestad | 202/248 |
| 4,124,451 | 11/1978 | Dix et al. | 202/248 |
| 4,131,421 | 12/1978 | Abendroth | 202/248 |
| 4,186,055 | 1/1980 | Baird et al. | 202/248 |
| 4,189,352 | 2/1980 | Stanke | 202/248 |
| 4,189,457 | 2/1980 | Clement, Jr. | 264/30 |
| 4,197,164 | 4/1980 | Pries | 202/256 |
| 4,198,274 | 4/1980 | Ikio | 202/248 |
| 4,217,177 | 8/1980 | Gerding et al. | 202/248 |
| 4,226,679 | 10/1980 | Kelly et al. | 202/248 |
| 4,259,159 | 3/1981 | Hohler | 202/269 |
| 4,263,101 | 4/1981 | Thiersch et al. | 202/248 |
| 4,290,372 | 9/1981 | Sato | 110/173 R |
| 4,293,389 | 10/1981 | Clement | 202/248 |
| 4,295,938 | 10/1981 | Haaf | 202/248 |

(List continued on next page.)

FOREIGN PATENT DOCUMENTS

| | | |
|---|---|---|
| 1099660 | 4/1981 | Canada . |
| 1059356 | 11/1992 | China . |
| 1059357 | 11/1992 | China . |
| 0023273 | 6/1980 | European Pat. Off. . |
| 0225970 | 8/1986 | European Pat. Off. . |
| 0831202 | 8/1938 | France . |
| 0397385 | 8/1933 | Germany . |
| 0814897 | 9/1951 | Germany . |
| 0864545 | 1/1953 | Germany . |
| 0913764 | 6/1954 | Germany . |
| 2755020 | 6/1979 | Germany . |
| 3105703 | 6/1982 | Germany . |
| 3528511 | 8/1986 | Germany . |
| 59-122580 | 7/1984 | Japan . |
| 1426927 | 3/1976 | United Kingdom . |
| 2156846 | 10/1985 | United Kingdom . |

*Primary Examiner*—Scott Kastler
*Attorney, Agent, or Firm*—Wood, Herron & Evans, LLP

[57] ABSTRACT

A coke oven door comprises a door frame, a plate mounted so as to be freely movable relative to the door frame within limits and a seal operatively mounted to the plate and positioned around the periphery of the frame for effecting sealing against the jamb of a coke oven. In a preferred form, the door comprises a first plate mounted so as to be freely movable relative to the door frame within limits and a second plate mounted to the first plate, having a seal mounted around the periphery thereof and having refractory plugs mounted thereto. Force applying members are mounted around the periphery of the door frame and are selectively adjustable to contact and move the first plate. Force applying members are mounted around the periphery of the first plate and are selectively adjustable to contact and move the seal. Angle sections mounted to the door frame and retainer clips mounted to the first plate cooperate to limit movement of the first plate.

22 Claims, 2 Drawing Sheets

U.S. PATENT DOCUMENTS

| | | | |
|---|---|---|---|
| 4,366,028 | 12/1982 | Abendroth | 202/248 |
| 4,381,972 | 5/1983 | Stog | 202/248 |
| 4,400,240 | 8/1983 | Abendroth | 202/248 |
| 4,412,891 | 11/1983 | Abendroth | 202/248 |
| 4,427,494 | 1/1984 | Naevestad | 202/248 |
| 4,429,908 | 2/1984 | Ernst | 202/248 |
| 4,486,271 | 12/1984 | Lorenz | 202/248 |
| 4,532,010 | 7/1985 | Dürslen et al. | 202/248 |
| 4,552,623 | 11/1985 | Urbye et al. | 202/248 |
| 4,647,343 | 3/1987 | Stog et al. | 202/248 |
| 4,655,488 | 4/1987 | Friedrichs et al. | 292/66 |
| 4,676,873 | 6/1987 | Haaf et al. | 202/242 |
| 4,741,808 | 5/1988 | Holz et al. | 202/248 |
| 4,770,749 | 9/1988 | Schlösser | 202/242 |
| 4,883,002 | 11/1989 | Schuster | 110/173 R |
| 4,917,772 | 4/1990 | Koschlig et al. | 202/242 |
| 5,238,539 | 8/1993 | Baird | 202/248 |
| 5,306,396 | 4/1994 | Schlösser et al. | 202/248 |
| 5,443,696 | 8/1995 | Baird et al. | 202/248 |
| 5,556,515 | 9/1996 | Giunta et al. | 202/248 |

COKE OVEN DOOR

FIELD OF THE INVENTION

This invention relates generally to coke oven doors, and more particularly to a coke oven door of an improved construction for effecting more efficient sealing engagement of the seal of the door with the sealing surface of a door jamb of a coke oven.

BACKGROUND OF THE INVENTION

Coke oven doors in use today are of various constructions and include various types of sealing structures for effecting a seal between the oven door and a jamb of a coke oven. One type of door utilizes a relatively rigid door frame to which is peripherally mounted a seal in the form of a metal strip, a knife edge of which contacts the door jamb sealing surface generally perpendicularly for sealing therewith.

In use, the door jamb of a conventional coke oven tends to become warped or distorted due to the extreme temperatures to which the jamb is subjected during the coking process. In addition, the coking process generates a hard carbon deposit, which deposit tends to coat the door jamb sealing surface creating irregularities around its periphery.

A disadvantage of conventional coke oven doors is the lack of any provision with which to adjust the overall contour of the door to provide for proper sealing of the door with the door jamb when the jamb has become warped or distorted.

Another disadvantage of coke oven doors of previous designs is the sealing structure's inability to compensate for hard carbon deposit, generated by the firing of the coke oven, which has coated the door jamb. Such accumulation of deposit on the door jamb creates irregularities around the periphery of the jamb sealing surface and prevents the knife edge of the typical coke oven door seal from effecting a complete seal around the periphery of the door jamb.

One attempt at providing adjustment force to a sealing edge is disclosed in U.S. Pat. No. 4,186,055, entitled Coke Oven Door, assigned to the assignee of the present invention, and hereby incorporated by reference herein as if fully set forth in its entirety. In that patent, there is disclosed the use of a pair of plates adjustably mounted through the use of a slot and pins for varyiny the amount of tension on the resilient middle portion of a diaphragm of the oven door.

Other attempts at providing for sealing edge adjustment are disclosed in U.S. Pat. Nos. 5,238,539 and 5,443,696, entitled Coke Oven Door and Coke Oven Door respectively, both of which are assigned to the assignee of the present invention, and each of which is hereby incorporated by reference herein as if fully set forth in its entirety. In these patents, there are disclosed coke oven door frames including a plurality of cuts or slots spaced along the door side frame members, and means spanning the cuts or slots for flexing the door frame into a desired configuration.

It is a main objective of the present invention to provide an improved coke oven door which is easier to adjust, maintain and repair, and which provides for more efficient sealing engagement of the door seal with the coke oven door jamb.

SUMMARY OF THE INVENTION

In accordance with the stated objective, the present invention is a coke oven door of improved construction which includes a number of features which provide for more efficient sealing engagement of a door seal with an oven jamb. In one aspect, the coke oven door comprises a door frame, a first plate mounted so as to be freely movable relative to the door frame within limits, a second plate mounted to the first plate, the second plate having a seal mounted around the periphery thereof for effecting sealing against a jamb of a coke oven, and force applying members mounted around the periphery of the first plate selectively adjustable to contact either the periphery of the second plate or the seal and move the seal away from the first plate and toward the coke oven jamb.

In another aspect of the present invention, a coke oven door comprises a door frame, a first plate mounted so as to be freely movable relative to the door frame within limits, a second plate mounted to the first plate, the second plate having a seal mounted around the periphery thereof for effecting sealing against a jamb of a coke oven, and force applying members mounted around the periphery of the door frame selectively adjustable to contact the periphery of the first plate and limit movement of the first plate toward the door frame and move the first plate and hence the second plate and seal away from the door frame and toward the coke oven jamb.

In yet another aspect, the present invention provides a coke oven door comprising a door frame, a first plate mounted so as to be freely movable relative to the door frame within limits, a second plate mounted to the first plate, the second plate having a seal mounted around the periphery thereof for effecting sealing against a jamb of a coke oven, and cooperating structure mounted on the door frame and the first plate limiting movement of the first plate away from the door frame.

In still another aspect of the present invention, a coke oven door comprises a door frame, a plate mounted so as to be freely movable relative to the door frame within limits, and a seal operatively mounted to the plate and positioned around the periphery of the plate for effecting sealing against a jamb of a coke oven.

In a preferred form of the present invention, the coke oven door comprises a door frame including a pair of spaced lateral side frame members. A first plate is mounted so as to be freely movable relative to the door frame within limits. A second plate is mounted to the first plate. The second plate has a seal mounted around the periphery thereof for effecting sealing against a jamb of a coke oven. Refractory plugs are mounted to the second plate. Spring loaded plunger bolts are mounted around the periphery of the first plate and are selectively adjustable to contact either the periphery of the second plate or the seal and move the seal away from the first plate and toward the coke oven jamb. Plunger bolts are mounted around the periphery of the door frame and are selectively adjustable to contact the periphery of the first plate and limit movement of the first plate toward the door frame and move the first plate and hence the second plate and seal away from the door frame and toward the coke oven jamb. Angle sections are mounted to the door frame lateral side frame members. Retainer clips are mounted to the first plate and cooperate with the angle sections. The angle sections and retainer clips permit movement of the first plate toward the door frame and prevent movement of the first plate away from the door frame beyond the point at which the retainer clips contact the angle sections.

The major advantages of the coke oven door of the present invention are that it is easier to adjust, maintain and repair as opposed to previous coke oven doors. The design allows for flotation of the entire seal via the free-floating plate to allow initial adjustment of the seal to the distortion of the oven jamb sealing surface. Thus the plane of the seal may be initially matched up with the plane of the door jamb thus avoiding undue strain and pressure on the seal in the event that the planes of the seal and jamb are other than parallel. Zone adjustment is accomplished by manipulating the bolts attached to the door frame to apply force against the free-floating first plate as needed. Localized point location adjustment is then accomplished in selected areas within the zones by manipulating the spring loaded plunger bolts attached to the first plate to apply force to the seal (or to the second plate to which the seal is mounted, as the case may be) as needed. The refractory plugs, being attached to the diaphragm plate, facilitate disassembly and reassembly of the door for maintenance and repair purposes.

These and other objects and advantages of the present invention will become more readily apparent during the following detailed description taken in conjunction with the drawings herein, in which:

DETAILED DESCRIPTION OF THE INVENTION

Figure 1:
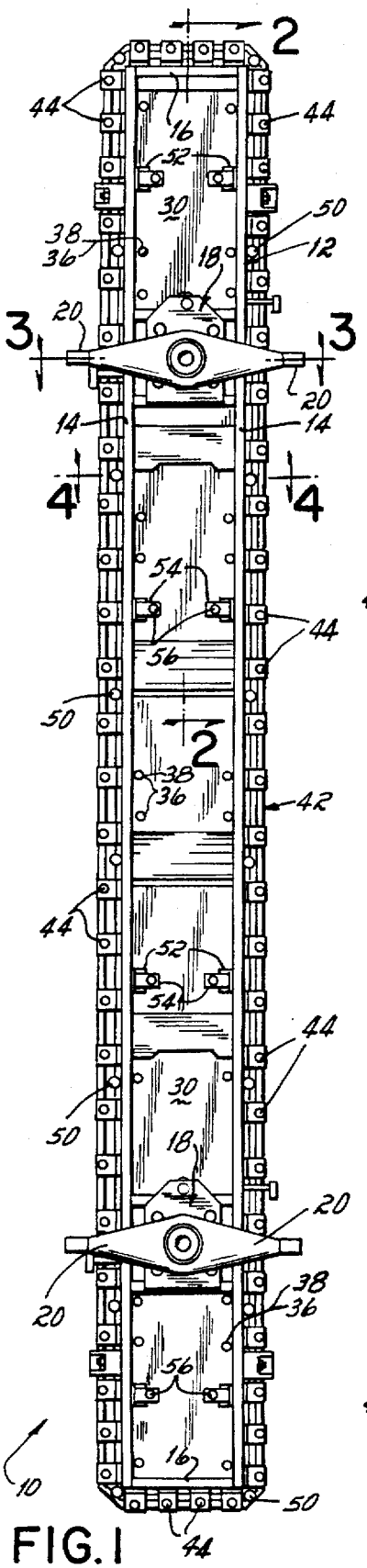
FIG. 1 is a front elevational view of the coke oven door of the present invention.
Figure 2:
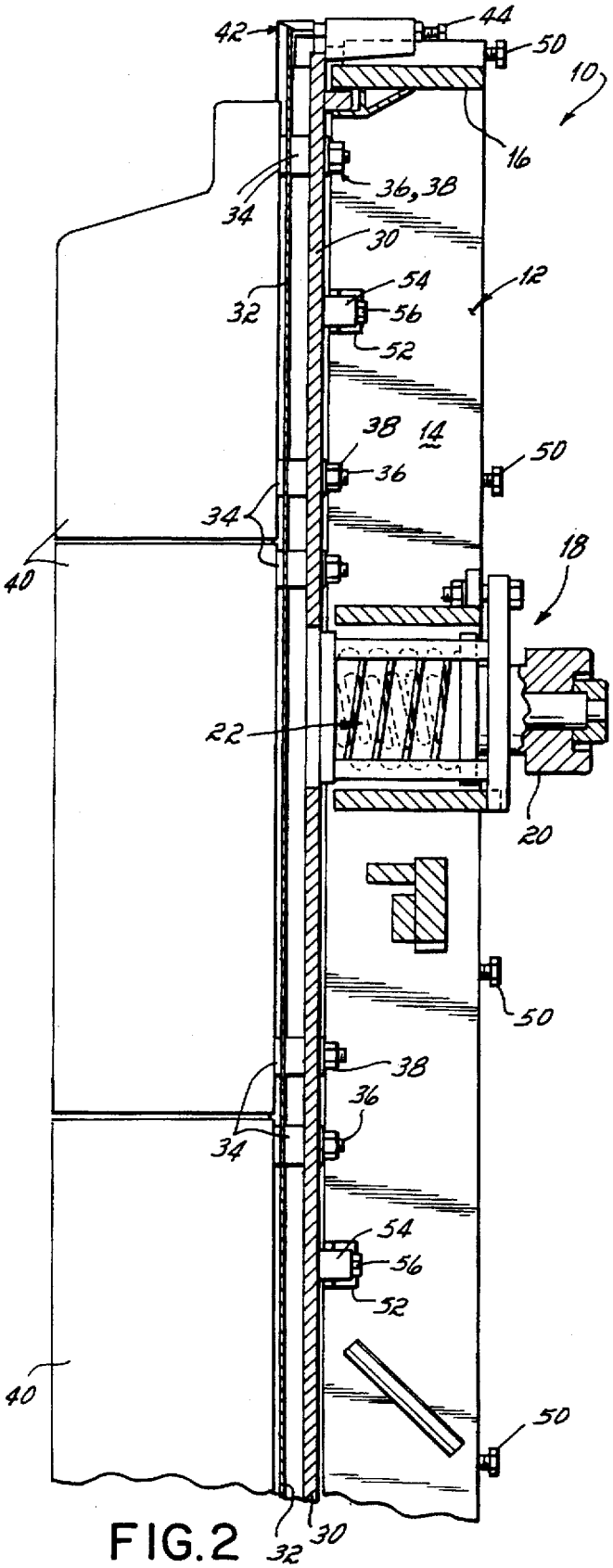
FIG. 2 is a view taken along line 2—2 of FIG. 1.

Referring first to FIG. 1, there is illustrated a coke oven door 10 according to the principles of the present invention. The door 10 includes a door frame 12 including a pair of spaced lateral side frame members 14 and a pair of spaced longitudinal end frame members 16 connected between the lateral side frame members 14. The door 10 includes a pair of locks 18 to lock the door 10 to a jamb (not shown) of a coke oven (not shown). Locks 18 include locking arms or latch bars 20 and suitable compression springs 22 and the like, all of which are conventional.

Figure 3:
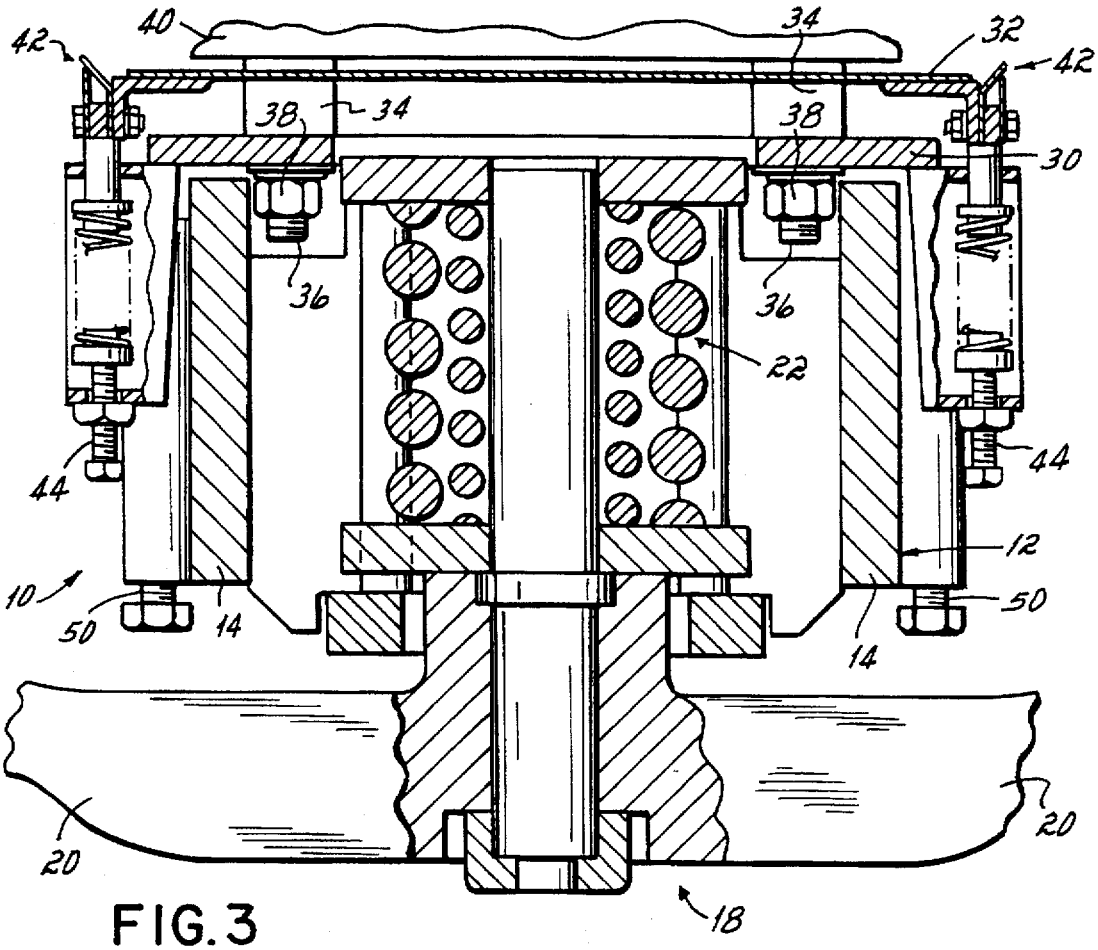
FIG. 3 is a view taken along line 3—3 of FIG. 1.

Referring now to all the Figures, and in particular to FIGS. 3 and 4, a first plate 30 is mounted so as to be freely movable or "free-floating" relative to the door frame 12, within limits, as will be described in more detail below. Plate 30 may sometimes referred to as a "flex plate". A second plate 32 is mounted to the first plate 30 via the use of spacers 34, bolts 36 and nuts 38. Plate 32 may sometimes be referred to as a "diaphragm plate". Bolts 36 and nuts 38 also secure refractory plugs 40 to the plate 32 and hence to the plate 30. Plate 32 includes a seal 42 mounted around its periphery for effecting sealing against the jamb of the coke oven. The seal 42 is generally of the type disclosed in U.S. Pat. No. Re. 34,184, entitled Retrofit Coke Oven Door Seal, assigned to the assignee of the present invention, and hereby incorporated by reference herein as if fully set forth in its entirety.

Spring loaded plunger bolts 44 are mounted around the periphery of the first plate 30 and are selectively adjustable to contact the seal 42 to move the seal 42 away from the first plate 30 and toward the coke oven jamb. Of course it will be appreciated that alternative mountings of seal 42 to plate 32 may be employed wherein it may be desired or required to have bolts 44 contact the periphery of the plate 32 to move the plate 32 and hence the seal 42 away from the first plate 30 and toward the coke oven jamb; it is contemplated that the present invention encompass all such alternative mountings.

Plunger bolts 50 are mounted around the periphery of the door frame 12 to the spaced lateral side frame members 14 and are selectively adjustable to contact the periphery of the first plate 30 to 1) limit movement of the first plate 30 toward the door frame 12 and 2) move the first plate 30 and hence the second plate 32 and seal 42 away from the door frame 12 and toward the coke oven door jamb. Angle sections 52 are mounted as by welding to the door frame lateral side frame members 14. Retainer clips 54 are secured to the plate 30 with bolts 56. The retainer clips 54 and angle sections 52 cooperate to permit movement of the first plate 30 toward the door frame 12 until such time as the plate 30 contacts the bolts 50 or the plate 30 contacts the side frame members 14, whichever occurs first, and permit movement of the first plate 30 away from the door frame 12 until such time as the retainer clips 54 contact the angle sections 52 or otherwise prevent movement of the first plate 30 away from the door frame 12 beyond the point at which the retainer clips 54 contact the angle sections 52.

Figure 4:
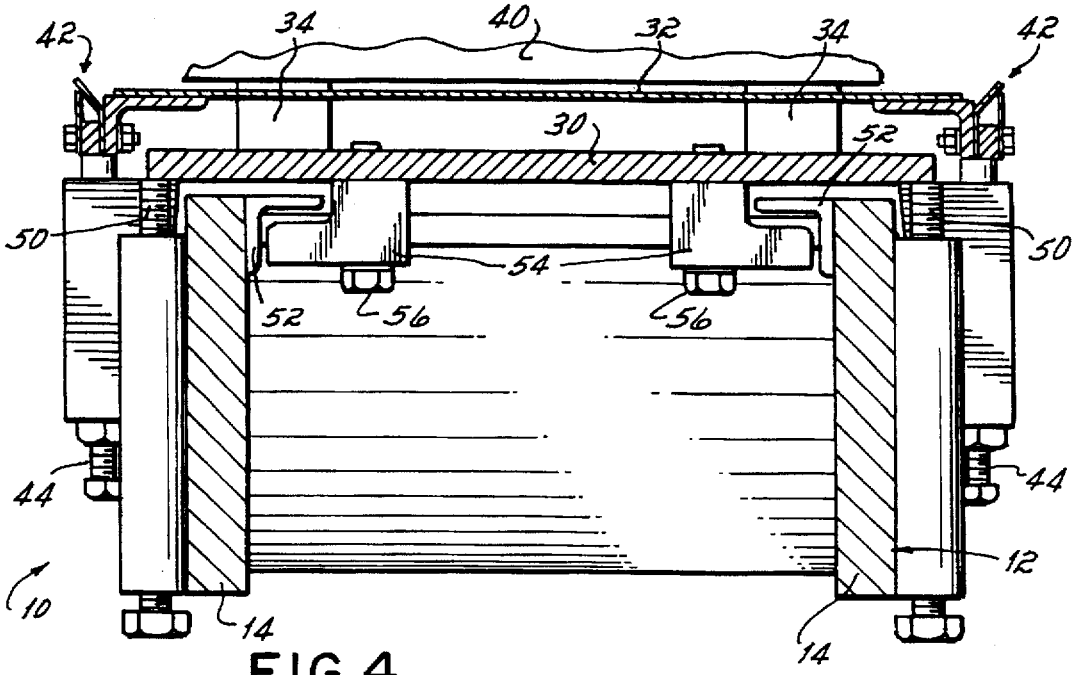
FIG. 4 is a view taken along line 4—4 of FIG. 1.

As best seen in FIG. 4, angle sections 52 and clips 54 allow, preferably, about + or −⅜" of free-floating movement of the plate 30, and hence plate 32 and seal 42, relative to the door frame 12 when the plunger bolts 50 are sufficiently unscrewed or backed off relative to the plate 30. The plate 30 is preferably about ¾" thick, whereas the plate 32 is preferably about 3/16" thick. Both plates are preferably fabricated of steel.

In use, plunger bolts 50 are initially unscrewed or otherwise withdrawn to allow the full + or −⅜" "free-float" of plate 30, and hence plate 32 and seal 42, relative to the door body 12. The coke oven door is then assembled onto the jamb of the coke oven and locked in place. Flotation of the entire seal 42 about the door jamb allows for initial adjustment of the seal 42 to the door jamb sealing surface, allowing for the respective planes of the seal and jamb sealing surface to self-adjust prior to locking the door onto the oven thus eliminating any undue pressure and strain on the seal due to mismatch of the seal and jamb planes. Zone adjustment is then accomplished by applying pressure to the periphery of the plate 30 via manipulation of the plunger bolts 50 to apply force to the plate 30. Lastly, localized point location adjustment is accomplished within particular zones via manipulation of the spring loaded plunger bolts 44 to apply force to the seal 42. The plunger bolts 50 and 44 may be advanced toward the door jamb or withdrawn away from the door jamb as needed to place the sealing knife edge of the seal 42 into engagement with the jamb sealing surface around the entire periphery of the door and jamb.

The floating design of the diaphragm plate allows the seal to adjust initially to distortions in the door jamb sealing surface and mismatch between the jamb/seal planes by self adjusting its relative position each time the coke oven door seal is placed against the door jamb sealing surface and locked onto the coke oven. The zone adjustment is accomplished by adjusting the peripherally located bolts around the door body to either place pressure on or relieve pressure from the flex plate, which results in distorting the flex plate to move the diaphragm plate and hence the seal. The final point location adjustment, if needed, is accomplished by adjusting the peripherally located spring loaded plunger bolts around the flex plate which in turn distorts the seal against the sealing surface to further conform to the door jamb sealing surface in the area directly under the spring loaded plunger. Thus an efficient seal is effected around the entire periphery of the door, and damage to the door seal due to localized uneven loading of the seal during locking of the door onto the oven due to seal/jamb planar mismatch is avoided.

Those skilled in the art will readily recognize numerous adaptations and modifications which can be made to the present invention which will result in an improved coke oven door, yet all of which will fall within the spirit and scope of the present invention as defined in the following claims. Accordingly, the invention is to be limited only by the scope of the following claims and their equivalents.

What is claimed is:

1. A coke oven door comprising:

a door frame;

a first plate spaced from said door frame and mounted so as to be freely movable relative to said door frame;

a second plate separate from said first plate and mounted to said first plate, said second plate having a seal mounted around the periphery thereof for effecting sealing against a jamb of a coke oven; and force applying members mounted around the periphery of said first plate selectively adjustable to contact one of the periphery of said second plate and said seal and move said seal away from said first plate and toward the coke oven jamb.

2. The coke oven door of claim 1 further comprising refractory plugs mounted to said second plate.

3. The coke oven door of claim 1 wherein said force applying members are spring loaded plunger bolts.

4. A coke oven door comprising;

a door frame;

first plate mounted so as to be freely movable relative to said door frame;

a second plate mounted to said first plate, said second plate having a seal mounted around the periphery thereof for effecting sealing against a jamb of a coke oven; and force applying members mounted around the periphery of said first plate selectively adjustable to contact one of the periphery of said second plate and said seal and move said seal away from said first plate and toward the coke oven jamb;

said door further comprising:

force applying members mounted around the periphery of said door frame selectively adjustable to contact the periphery of said first plate and limit movement of said first plate toward said door frame and move said first plate and hence said second plate and seal away from said door frame and toward the coke oven jamb.

5. The coke oven door of claim 4 wherein said force applying members are plunger bolts.

6. The coke oven door of claim 1 further comprising:

cooperating structure mounted on said door frame and said first plate limiting movement of said first plate away from said door frame.

7. A coke oven door comprising:

a door frame;

a first plate mounted so as to be freely movable relative to said door frame;

a second plate mounted to said first plate, said second plate having a seal mounted around the periphery thereof for effecting sealing against a jamb of a coke oven;

force applying members mounted around the periphery of said first plate selectively adjustable to contact one of the periphery of said second plate and said seal and move said seal away from said first plate and toward the coke oven jamb; and cooperating structure mounted on said door frame and said first plate limiting movement of said first plate away from said door frame;

wherein said door frame comprises a pair of spaced lateral side frame members and wherein said cooperating structure comprises:

angle sections mounted to said door frame lateral side frame members; and retainer clips mounted to said first plate and cooperating with said angle sections;

said angle sections and retainer clips permitting movement of said first plate toward said door frame and preventing movement of said first plate away from said door frame beyond the point at which said retainer clips contact said angle sections.

8. A coke oven door comprising:

a door frame;

a first plate spaced from said door frame and mounted so as to be freely movable relative to said door frame;

a second plate separate from said first plate and mounted to said first plate, said second plate having a seal mounted around the periphery thereof for effecting sealing against a jamb of a coke oven; and force applying members mounted around the periphery of said door frame selectively adjustable to contact the periphery of said first plate and limit movement of said first plate toward said door frame and move said first plate and hence said second plate and seal away from said door frame and toward the coke oven jamb.

9. The coke oven door of claim 8 further comprising refractory plugs mounted to said second plate.

10. The coke oven door of claim 8 wherein said force applying members are plunger bolts.

11. The coke oven door of claim 8 further comprising:

cooperating structure mounted on said door frame and said first plate limiting movement of said first plate away from said door frame.

12. A coke oven door comprising:

a door frame:

a first plate mounted so as to be freely movable relative to said door frame;

a second plate mounted to said first plate, said second plate having a seal mounted around the periphery thereof for effecting sealing against a jamb of a coke oven;

force applying members mounted around the periphery of said door frame selectively adjustable to contact the periphery of said first plate and limit movement of said first plate toward said door frame and move said first plate and hence said second plate and seal away from said door frame and toward the coke oven jamb; and cooperating structure mounted on said door frame and said first plate limiting movement of said first plate away from said door frame;

wherein said door frame comprises a pair of spaced lateral side frame members and wherein said cooperating structure comprises:

angle sections mounted to said door frame lateral side frame members; and retainer clips mounted to said first plate and cooperating with said angle sections;

said angle sections and retainer clips permitting movement of said first plate toward said door frame and preventing movement of said first plate away from said door frame beyond the point at which said retainer clips contact said angle sections.

13. A coke oven door comprising:

a door frame;

a first plate spaced from said door frame and mounted so as to be freely movable relative to said door frame;

a second plate separate from said first plate and mounted to said first plate, said second plate having a seal mounted around the periphery thereof for effecting sealing against a jamb of a coke oven; and cooperating structure mounted on said door frame and said first plate limiting movement of said first plate away from said door frame.

14. The coke oven door of claim 13 further comprising refractory plugs mounted to said second plate.

15. A coke oven door comprising:

a door frame;

a first plate mounted so as to be freely movable relative to said door frame;

a second plate mounted to said first plate, said second plate having a seal mounted around the periphery thereof for effecting sealing against a jamb of a coke oven; and cooperating structure mounted on said door frame and said first plate limiting movement of said first plate away from said door frame;

wherein said door frame comprises a pair of spaced lateral side frame members and wherein said cooperating structure comprises:

angle sections mounted to said door frame lateral side frame members; and retainer clips mounted to said first plate and cooperating with said angle sections;

said angle sections and retainer clips permitting movement of said first plate toward said door frame and preventing movement of said first plate away from said door frame beyond the point at which said retainer clips contact said angle sections.

16. A coke oven door comprising:

a door frame;

a plate mounted so as to be freely movable relative to said door frame; and a seal operatively mounted to said plate and positioned around the periphery of said plate for effecting sealing against a jamb of a coke oven;

whereby movement of said plate relative to said door frame can occur without flexure of said seal.

17. The coke oven door of claim 16 further comprising refractory plugs operatively mounted to said second plate.

18. The coke oven door of claim 16 further comprising:

force applying members mounted around the periphery of said door frame selectively adjustable to contact the periphery of said plate and limit movement of said plate toward said door frame and move said plate and hence said seal away from said door frame and toward the coke oven jamb.

19. The coke oven door of claim 18 wherein said force applying members are plunger bolts.

20. The coke oven door of claim 16 further comprising:

cooperating structure mounted on said door frame and said plate limiting movement of said plate away from said door frame.

21. A coke oven door comprising:

a door frame;

a plate mounted so as to be freely movable relative to said door frame;

a seal operatively mounted to said plate and positioned around the periphery of said plate for effecting sealing against a jamb of a coke oven; and cooperating structure mounted on said door frame and said plate limiting movement of said plate away from said door frame;

wherein said door frame comprises a pair of spaced lateral side frame members and wherein said cooperating structure comprises:

angle sections mounted to said door frame lateral side frame members; and retainer clips mounted to said plate and cooperating with said angle sections;

said angle sections and retainer clips permitting movement of said plate toward said door frame and preventing movement of said plate away from said door frame beyond the point at which said retainer clips contact said angle sections.

22. A coke oven door comprising:

a door frame including a pair of spaced lateral side frame members;

a first plate mounted so as to be freely movable relative to said door frame;

a second plate mounted to said first plate, said second plate having a seal mounted around the periphery thereof for effecting sealing against a jamb of a coke oven, and refractory plugs mounted thereto;

spring loaded plunger bolts mounted around the periphery of said first plate selectively adjustable to contact one of the periphery of said second plate and said seal and move said seal away from said first plate and toward the coke oven jamb;

plunger bolts mounted around the periphery of said door frame selectively adjustable to contact the periphery of said first plate and limit movement of said first plate toward said door frame and move said first plate and hence said second plate and seal away from said door frame and toward the coke oven jamb;

angle sections mounted to said door frame lateral side frame members; and retainer clips mounted to said first plate and cooperating with said angle sections, said angle sections and retainer clips permitting movement of said first plate toward said door frame and preventing movement of said first plate away from said door frame beyond the point at which said retainer clips contact said angle sections.

* * * * *